United States Patent [19]

Fuhrer

[11] Patent Number: 4,841,705

[45] **Date of Patent: * Jun. 27, 1989**

[54] REINFORCED CEMENTITIOUS PANEL

[75] Inventor: John P. R. Fuhrer, Bolton, Canada

[73] Assignee: 698315 Ontario, Ltd., Canada

[ * ] Notice: The portion of the term of this patent subsequent to Aug. 19, 2003 has been disclaimed.

[21] Appl. No.: 37,807

[22] Filed: Apr. 13, 1987

[51] Int. Cl.[4] ..... E04B 2/04

[52] U.S. Cl. ..... 52/410; 52/309.7; 52/309.13; 52/344; 52/363

[58] Field of Search ..... 52/309.7, 309.8, 309.13, 52/309.14, 309.15, 408, 409, 410, 506, 509, 511, 512, 454, 741, 344, 361-363

[56] References Cited

U.S. PATENT DOCUMENTS

| | | | |
|---|---|---|---|
| 1,330,347 | 2/1920 | Richardson | 52/344 |
| 2,069,755 | 2/1937 | Foster | 52/408 X |
| 2,889,698 | 6/1959 | Stevens | 52/410 |
| 4,242,406 | 12/1980 | ElBouhnini et al. | 52/309.13 X |
| 4,558,550 | 12/1985 | Marchais et al. | 52/309.7 |
| 4,558,552 | 12/1985 | Reitter, II | 52/410 X |
| 4,606,168 | 8/1986 | Fuhrer | 52/741 |

FOREIGN PATENT DOCUMENTS

| | | | |
|---|---|---|---|
| 1148324 | 6/1983 | Canada | 52/410 |
| 2032988 | 2/1980 | United Kingdom | 52/408 |

*Primary Examiner*—David A. Scherbel
*Assistant Examiner*—Richard E. Chilcot, Jr.
*Attorney, Agent, or Firm*—Ratner & Prestia

[57] ABSTRACT

A building wall covering system for application to a wall support comprises a layer of insulative material and an overlying layer of matting which is attached to the wall support structure. The matting is particularly adapted to provide structural strength in the cementitious material applied thereto. The matting is of a bulkly layer of open construction formed by randomly directed interconnected flexible filaments. The cement layer is applied to fill the voids in the matting and cover same. A finish coat is applied to the layer of hardened cement material to complete the covering. The system has considerably enhanced impact resistance compared to existing systems.

10 Claims, 3 Drawing Sheets

REINFORCED CEMENTITIOUS PANEL

FIELD OF THE INVENTION

This invention relates to cementitious building materials which are reinforced to provide enhanced impact resistance. Such materials are particularly useful in building wall covering systems.

BACKGROUND OF THE INVENTION

Wall covering systems for interior and exterior of building walls using cement type coatings are popular in the building industry because of the relatively inexpensive form of construction and covering of large expanse of walls. Such coverings may be applied to refurbish existing building exteriors and interiors, or applied to new building construction.

Horbach, U.S. Pat. No. 3,389,518, provides a continuous finish for a building exterior. A form of cellular insulation is adhesively applied to building exterior. A continuous layer of cementitious material is applied over the cellular insulation and reinforcement in the form of glass fibre fabric or reinforcing fibres is incorporated in the cementitious material. A finish coat of synthetic materials, such as propionic acid ester or other binder materials, is applied to the cementitious layer. The finish coat may include a mineral aggregate for decorative purposes. The purpose of this structure is to prevent crack propagation in the building wall being transmitted to the newly completed surface, thereby preventing crack formation in the new finish. Horbach does not recommend the use of steel plates on the face of the insulation because of heat conductivity and their exceptional weight. The steel plates would have to be firmly secured to the building exterior and cannot compensate for temperature variations that can form cracks in the surface of the finish material applied to the insulation.

Heck, U.S. Pat. No. 4,318,258, discloses improvements in the use of Styrofoam (trademark) panels which are affixed to building walls. The insulation panelling has a special grooving arrangement to compensate for expansion and contraction in the panels. A cement layer is applied over top of the foam layers. The plaster or mortar may contain synthetic resins, such as methyl cellulose and polyvinyl propionate. Other suitable plastic resins include homopolymers, copolymers of acrylic acid and methacrylic acid, e.g. styrol acrylates and vinyl acetates. The foam slabs as grooved are glued to the building exterior in a manner similar to that discussed in Horbach, U.S. Pat. No. 3,389,518.

A comparable system involving the use of Styrofoam panels is disclosed in Canadian patent No. 1,148,324. The Styrofoam panels having grooves on the interior and the exterior are applied to a building wall using fasteners. The base coat of plaster or mortar is applied over the Styrofoam panels where the cementitious material is received in the outer grooves of the Styrofoam panels to ensure that the hardened base coat material is firmly affixed to the Styrofoam material. When the Styrofoam material moves due to expansion and contraction caused by temperature extremes, cracking in the base coat can occur.

Burrows, U.S. Pat. No. 4,044,520, discloses a building panel system which is a modular unit glued to the building exterior. Each building panel as preformed consists of a foamed resin insulation layer over which a base coat and finish coat are applied. A polymer fortified concrete base coat may be used. Polymer fortification of the cement may be provided by an acrylic polymer together with a defoaming agent. The outer facing layer may be of a synthetic binder material, such as an acrylic polymer optionally used in combination with concrete. Aggregate may be added to the binder material to enhance the appearance of the building panels. These individual preformed panels have edge portions formed in a manner so that, when the panels are glued to the building exterior, the edges overlap in a mating manner to provide a modular type exterior finish for the building. The unfortunate problem with this system is that, if the building exterior is of uneven plane, then the panels as applied to the building exterior also take on the uneven plane of the building.

Rubenstein, U.S. Pat. No. 2,850,890, discloses a precast building block having applied to an exterior surface thereof a polyester resin impregnated with fiberglass or like types of fibre reinforcing materials. Such fibres may be provided in the form of woven or unwoven mats, fibrous stranded materials or rope. The fibrous material is impregnated with polyester resins so as to adhere the fibrous material to the face of a concrete block and to essentially cover the thickness of the fibrous material. A finishing layer may be adhered to the layer of fibrous materials. The preferred type of fibrous material, as disclosed in this patent, is of the "Fiberglas" (trademark) type which would be in the form of a mat. This type of fibrous material is fairly dense and hence does not allow the resins to fully impregnate the layer of fibrous material resulting in poor adhesion of the fibrous material to the cement block. After the finish coat is applied to the fibrous material, it is possible over time that the polyester resins release their holding power on the cement blocks, thereby causing the surface finish to blister and fall away from the cement blocks.

Another form of wall cladding system, which involves the use of a form of fibrous insulation, is disclosed in U.S. Pat. No. 4,606,168. In that system, a plurality of insulation batts of fibrous material are affixed to a building wall by fasteners having plate portions with apertures extending therethrough. When the cementitious layer is applied over the insulation and forced through the apertures in the plates of the fasteners, a suspension of the exterior hardened cementitious layer is achieved by way of the fasteners. This accommodates expansion and contraction in the materials without inducing cracking in the exterior surface.

SUMMARY OF THE INVENTION

According to an aspect of this invention, a cementitious building wall covering system comprises a wall support structure, a layer of insulative material and a layer of matting overlying the insulated material. The insulated material and matting are applied to the wall support by spaced apart mechanical fasteners. The matting comprises a bulky layer of open construction formed by randomly directed interconnected flexible filaments. A continuous layer of hardened cementitious material fills and essentially covers the open construction of the matting. A hardened finish coat is adhered to the layer of cementitious material to complete the wall surface.

According to another aspect of the invention, an insulative panel for use in applying a building wall covering system to a wall support structure comprises a layer of insulation, a layer of matting having a bulky open construction formed by randomly directed, interconnected flexible filaments and means for securing a layer of matting to the insulative panel. The layer of matting is essentially the same size as the insulative panel and optionally may be offset relative to the face of the panel to provide for overlap of the matting with the joint between insulative panels when applied to a building wall.

According to another aspect of the invention, a method for applying a cementitious building wall covering system to a wall support structure comprises attaching with mechanical fasteners a layer of insulative material with overlying layer of matting to the wall structure. The layer of matting is of bulky open construction formed by randomly directed interconnected flexible filaments. A layer of cementitious material is applied to the matting to fill the open construction with and cover the layer of matting with the layer of cementitious material. The layer of cementitious material is allowed to harden. A finish coat is applied to the layer of cementitious material to complete the wall covering system.

According to a further aspect of the invention, a reinforced cementitious building structure having increased impact strength comprises in combination a hardened layer of cementitious material having embedded therein a bulky layer of matting. The matting has an open construction formed by randomly directed interconnected flexible filaments.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
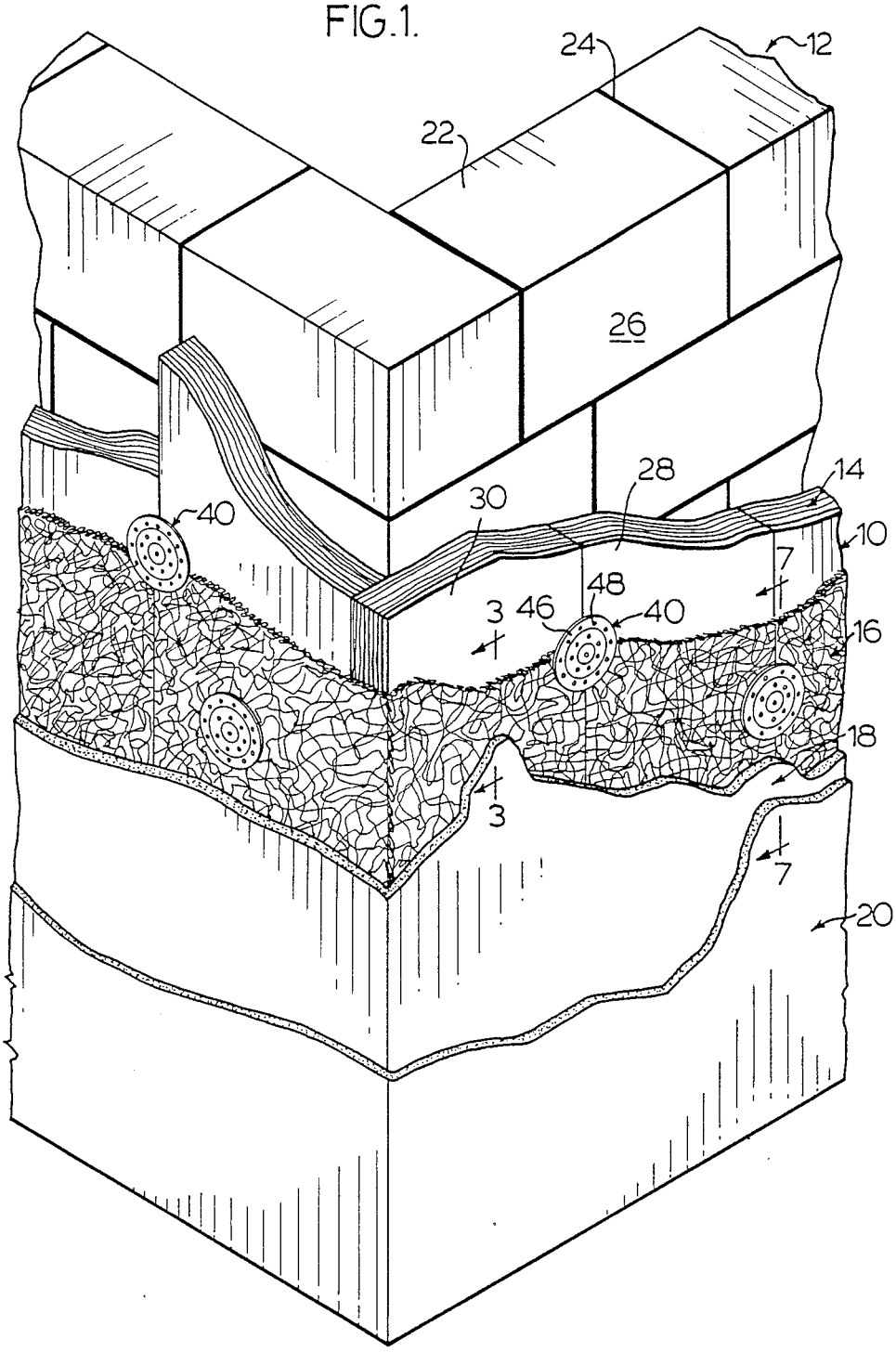
FIG. 1 is a perspective view of a building wall structure having applied thereto a building wall covering system according to a preferred embodiment of this invention.

A building wall covering system is shown in FIG. 1 wherein the building wall covering system 10 is applied to a building wall support structure generally designated 12. The building wall system 10 comprises a layer of insulative material 14 with an overlying layer of matting 16. A layer of cementitious material 18 is applied to the matting to fill voids therein and cover the matting. A finish coat 20 is then applied to the hardened layer of cementitious material. The building wall support structure may comprise a variety of structures such as brick, concrete or steel frame. According to a preferred embodiment, the wall consists of concrete blocks 22 secured to one another by mortar 24 in accordance with standard building practice. To enhance the energy efficiency of the building wall, a layer of insulative material 14 is applied to the building wall support surface 26. With respect to describing a preferred embodiment of this invention, it is appreciated that surface 26 may be either the interior or exterior surface of the building wall support structure, although it is appreciated that the wall covering system according to this invention is particularly adapted for exterior surface application to building walls. It is also appreciated that the building wall structure 12 may be an existing wall system which needs to be refurbished and hence covered by the system according to this invention to provide an improved surface finish effected by layer 20. Interior wall systems may be of residential or industrial type. For example, in industry the insulated system is particularly useful in refrigeration rooms.

Figure 4:
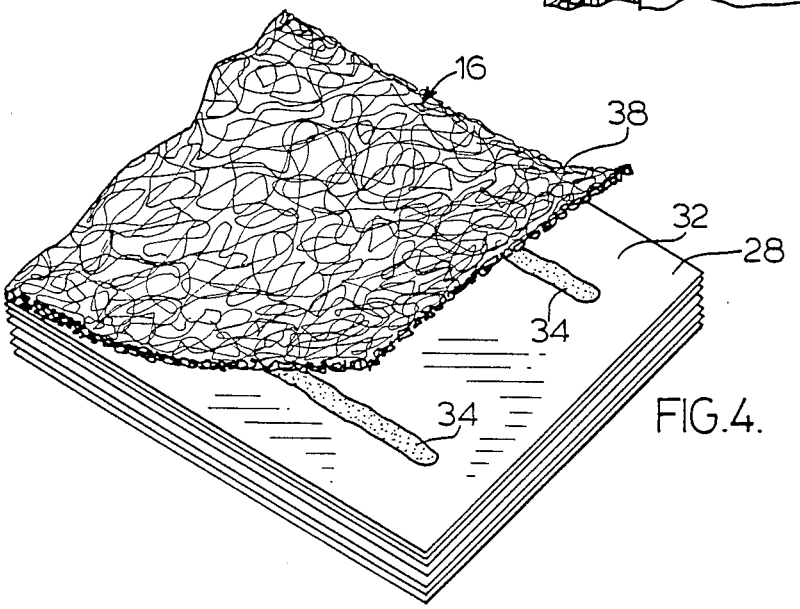
FIG. 4 is a view of an insulative panel having the matting secured thereto by adhesive.
Figure 5:
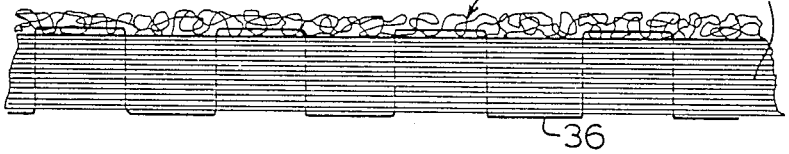
FIG. 5 is a section through an insulative panel having the matting secured thereto by way of stitching.

The insulative layer 14 may consist of individual panels, such as 28, 30, etc. The panels may be of a representative size such as two feet by four feet which is fairly standard in the construction industry and are of a size which are readily manageable and packaged. It is appreciated, however, that the insulative material may come in large sheets or may be unrolled and applied to the building surface 26. Overlying the panels is the matting 16 which may be of a dimension different from the panels and may also be of larger lengths or removed from a roll of material and applied to the exterior surface of the insulated panels. According to a preferred aspect of the invention, the matting 16 is in sections, each section being approximately the same size as the panel and overlying the panel. As shown in FIGS. 4 and 5, the matting 16 may be secured to the face 32 of panel 28 by strips of adhesive 34. Alternatively the section of matting 16 may be secured to the panel 28 by a suitable stitching 36. According to the embodiment shown in FIG. 1, the section of matting 38, as applied to the panel 28, is of essentially the same width and height as the insulated panel 28 and is coterminus with the edges of the insulative panel 28.

Figure 7:
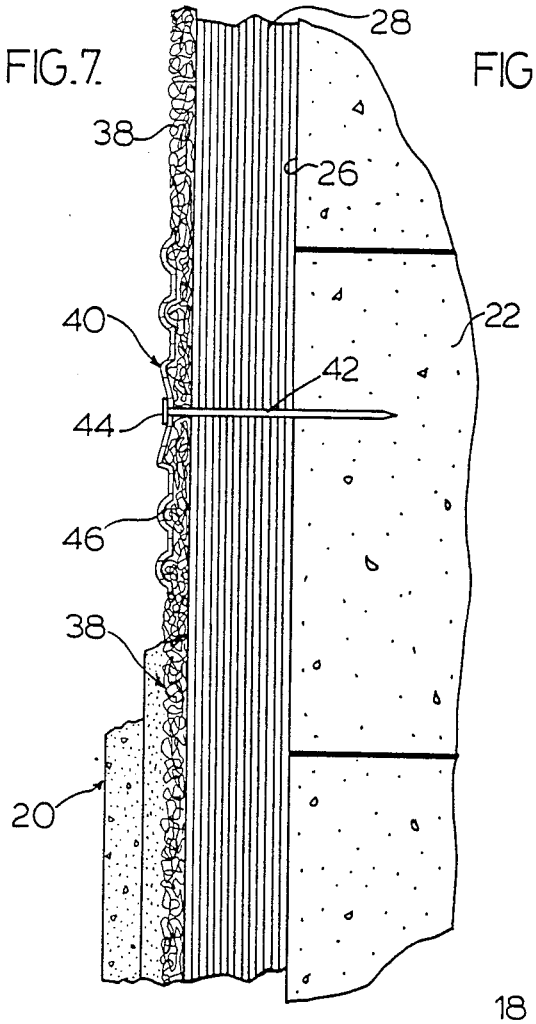
FIG. 7 is a section along the lines 7—7 of FIG. 1.

Mechanical fasteners 40 are used to attach the insulative panels with overlying matting to the surface 26 of the building wall structure 12. As shown in FIG. 7, each mechanical fastener 40 consists of a shank portion 42 which penetrates and extends through the matting 38 and the corresponding insulative panel 28 and is secured in the building wall block 22 by penetrating the block. The fastener shank 42 may be of the common type of concrete nail which is suitable for use in driving into concrete blocks and forming a secure grip on the block. It is appreciated though that many other types of fasteners may be used such as screw and anchor systems, self-tapping systems which are screwed into metal wall structures and the like which would serve the purpose of holding at its head portion 44 an enlarge circular rigid plate 46. As shown in FIG. 1, the enlarged circular plate 46 includes a plurality of apertures 48. The apertures are adjacent the matting 38. The fastener 42 is only driven in so far as to slightly compress the matting 38 and not overly compress the insulative layer 28.

Figure 6:
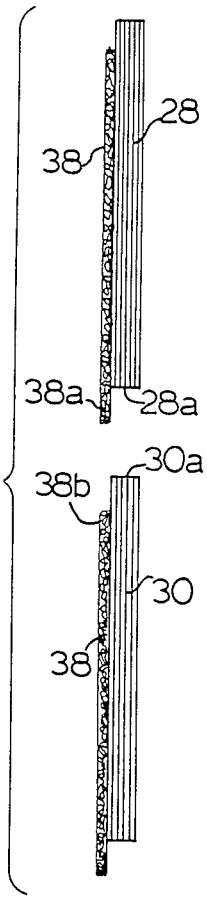
FIG. 6 is a side view of two insulative panels with the matting secured thereto in offset relationship.

As shown in FIG. 6, the matting sections 38 may be offset relative to the respective insulative panels 28 and 30. When the panel edges **28*a* and 30*a* are positioned adjacent one another in covering a wall system, the portion 38*a* of the matting on panel 28 overlaps the joint between the faces 28*a* and 30*a*. The second section 38, as secured to panel 30, then forms a joint of the matting at portions 38*a* and 38*b***. Hence the matting always overlaps and forms a more secure interconnection for the joint between the individual panels.

Figure 2:
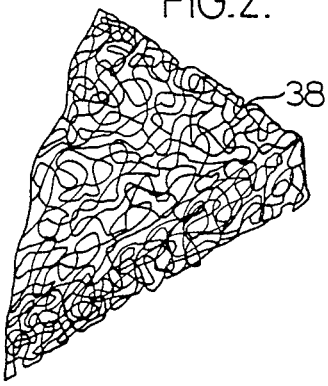
FIG. 2 is an enlarged view of the matting applied to the surface of the insulative material used in the building wall covering system.

The layer of matting 16 and the section thereof 38 as shown in FIG. 2 is of bulky open construction formed by randomly directed interconnected flexible filaments. A preferred source of such matting is that available from America Enka Company as sold under the trade mark ENKAMAT. This particular three dimensional matting is made from Nylon (trademark) monofilaments fused at their intersections. It is appreciated that the material for matting may be of other types of suitable synthetic materials which may be similarly constructed to form the bulky matting. Normally, such material is used in sodding installations to control soil erosion by providing a medium in which grass roots may grow. It has been surprisingly found, however, that in the construction of building wall systems the covering and filling of the voids in such bulky matting with a cementitious material provides a considerably improved building facing. As shown in FIG. 2, the matting consists of individual flexible monofilaments which do not have any preconceived orientation and are interconnected at various intersections to provide a mat structure having a distinct length, width and thickness dimension. The majority of the matting is void. Normally such matting may be up to 10% or thereabouts solid, the remainder being void. According to a preferred aspect of this invention, such monofilaments may be formed of Nylon and in particular Nylon 6. Carbon black may be included in the Nylon monofilament to provide weather resistance in the Nylon. The preferred matting has the following physical characteristics.

TABLE 1

| | |
|---|---|
| Weight(g/sq m) | 405 ± 7% |
| Thickness (mm) (minimum) | 18 (0.8 in) |
| Width (cm) | 97 (38 in) |
| Filament Diameter (mm) (minimum) | .40 |
| Tensile* | |
| Strength (kg/m - minimum) | |
| Length direction | 140 |
| Width direction | 80 |
| Elongation (% minimum) | |
| Length direction | 50 |
| Width direction | 50 |
| Resiliency | |
| 30-Min. Recovery (%) | 80 |

*ASTM 1682 strip test procedure modified to obtain filament bond strength is used to indicate tensile properties of matting The insulative panel over which the matting lies may be of a variety of materials commonly used in the building trade. For example, the panels may be of fibrous insulation batts developed from an assorted form of natural and synthetic fibres. For example, the fibrous batts may be of Fiberglas (trademark) insulation in the form of a fine fibered, shock free insulation board which is semi-rigid and of controlled density and thickness which is bonded by a thermosetting resin to give it the semi-rigid form of structure for application to the building exterior. The thickness of the insulation batts is compressed and may range from one to four inches depending upon the application to which the insulative material is put. The Fiberglas insulation is inherently fire safe with a ULC flame spread rating of 15. The insulation material is moisture resistant in that moisture will not affect the glass fibres. However, the Fiberglas insulation batts are water permeable to allow the diffusion of moisture in either direction through the insulation layer.

It is appreciated that several other forms of fibrous types batts may be used, such as mineral fibrous material and naturally occurring fibrous material which when compacted provide a surface to which the matting is connected.

It is also appreciated that the insulating layer may be formed of expanded polymeric materials such as Styrofoam (trademark) sheets. These foam sheets are normally of relatively flexible material and would normally have the matting secured to the face thereof by suitable adhesive. The adhesive should be of relatively flexible composition to accommodate expansion and contraction in not only the cementitious material applied to the matting, but also in the insulative material.

The cementitious material applied to the matting and covering the insulative layer is normally of vapor permeable material to allow diffusion of vapor in both directions through the building exterior. The cementitious material may be formed of a Portland Cement with filler and aggregate. The cement material may be modified with a synthetic material to improve its binding characteristics and provide a more resilient layer. To add to the strength of the cement material, fibres may be added to the cementitious layer. For example, "AR" (trademark) glass fibres may be added to the cementitious layer. The fibres are chopped strand glass fibres sold by Owens-Corning Fiberglas Corp. of Toledo, Ohio. The glass fibre strengthens the Portland Cement where such fibres are inherently alkali resistance. As a result, the fibres can add considerably to the structural strength of the cementitious coating and provide a degree of flexibility in the base coating when hardened to avoid development of hairline cracks in the coating due to any movement between the wall covering system and the wall supporting structure. The various desired properties of fibre reinforced concretes are disclosed in "State of the Art Report on Fibre Reinforcing Concrete", ACI Journal/November 1983.

A variety of fibre reinforced cementitious coatings are available. For example, the surface bonding cement distributed under the trademark "SHER WALL" by W. R. Bonsal Company of Lyleville, N.C.; "GEMITE" (trademark) fibre reinforcing cement manufactured and sold by Gemite Limited of Ontario, Canada; "FIBER-WALL" manufactured and sold by Construmat Inc. of Ontario, Canada are all acceptable, usable forms of fibre reinforced cementitious materials. The "FIBER-WALL" sold by Construmat is a synthetic modified cementitious material which includes an acrylic polymer binder material to improve the adhesion characteristic and the ability of the hardened base coat deflects to a certain degree in accommodating relative movement with respect to building wall and not inducing cracks in the finished coat.

The vapor permeable finish coat may include various types of paints or synthetic layer. The finish coat 20 includes a synthetic binder with pebbles, aggregates and the like to present an attractive appearance as desired by the user and consumer. To provide a finish coat with a textured finish, the synthetic binder may be an acrylic-styrene polymer composition having elastic properties in combination with the filler materials. The acrylic-styrene polymer material may be obtained from many sources such as that sold under the trademark "ACRONAL" 290D by BASF of West Germany. The acrylic-styrene polymer material is mixed with solvents, such as aromatics containing white spirit, butyldigol, butylethanol, butyldigol acetate, pine oils or the blends thereof with alcohols such as methanol, ethanol, or isopropanol to improve the freeze/thaw stability. Butyldigol, ethylene glycol and propylene glycol may be added to prevent the finishes from drying too rapidly. Plasticizers such as dioctyl, phthalate may be added to the finish coat to increase its resiliency. The fillers used with this mixture include aggregate usually ranging in grain size from 1 mm up to 2.5 mm and other fillers such as calcite, wollastorite or mixtures thereof.

These textured finishes are usually premixed at the site. The finish coat 20 is applied to the base coat 18 with a trowel or like device to provide a vapor permeable finish coat. Such premixed finish coat may be obtained from Construmat Inc. of Canada under the trademarks SCRUBBETEX and GRAFFIATO. Another form of textured finish coat is available from Rohm & Haas under the trademark RHO-PLEX MC-76.

The vapor permeability of the wall covering system is sufficient to provide for water vapor transmission in both directions through the wall covering. This ensures that excess moisture build up does not occur in dead spaces in the wall construction and hence avoids rapid deterioration of the wall structure.

In applying the base coat 18 and finish coat 20 to the building wall, it is important that a sufficient number of fasteners be used so that the hardened base coat and finish coat with the bulky open construction matting embedded therein are suspended from the building wall. It has been found that approximately one fastener or more per $1\frac{1}{2}$ square feet of applied insulative panelling with matting is required to adequately support and suspend the cementitious base coat and finish coat from the building exterior. Preferably at least one fastener is used for every square foot of insulation applied. The insulative layer does not serve to provide any appreciable support to the outer wall, since the load is taken up by the fastener plates. It is understood, however, that in using solid types of insulative material, such as Styrofoam, that such Styrofoam may include grooves or the like which would enhance supporting of the outer building finish to the building wall.

Figure 3:
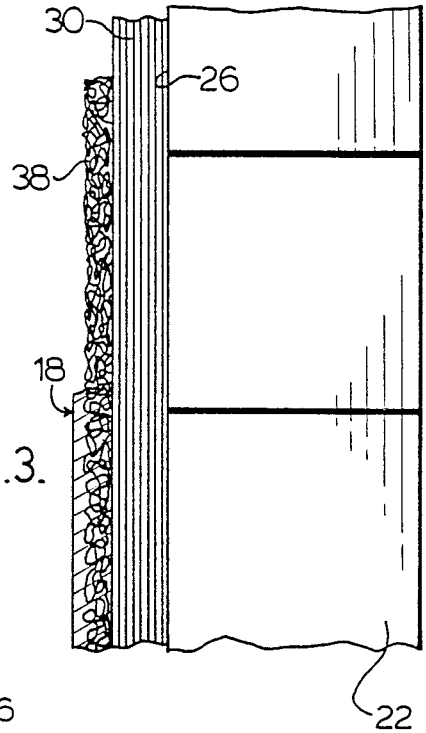
FIG. 3 is a section taken along the line 3—3 of FIG. 1.

With the fasteners in place having the plate portions located on the matting in the manner shown in FIG. 1, the base coat of selected cementitious material is applied by hand or machine. The cementitious material is sufficiently fluid to flow into all voids in the matting 16 to fill the voids and hence have the filaments of the matting embedded in the cementitious material. With the first layer applied as shown in FIG. 3, the thickness of the base layer 18 is of sufficient thickness to fill all voids in the matting section 38 and is thicker than the nominal thickness of the matting 38. This ensures that all filaments of the matting are covered. Also, as shown in FIG. 7, the thickness of the base boat 38 is sufficient to cover the rigid plates 46 while such cementitious material passes through the apertures 48 in the plates 46 and at the same time, permeates through the filaments of the underlying matting material. Such hardened cement, as it passes through the apertures in the plates 46, serves to secure or bind the matting to the base coat 38 in the areas of the fasteners and hence assist in the overall supporting of the exterior cementitious material from the building wall support structure 12.

After the base coat has hardened, the finish coat 20 may be applied thereto. As shown in FIG. 7, the finish coat is normally of a lesser thickness than the base coat 38 and is of one or more of the above noted selected materials for the finish coat.

In circumstances where a fibrous insulation material, such as Fiberglas batts, are used in insulating the wall surface, it is appreciated that such fibrous insulation does not serve to provide any appreciable support to the outer cementitious layer. The load instead is taken up by the fastener plates. The fibre structure of the insulation layer permits movement of the outer wall relative to the building wall due to a thermal expansion and contraction of the wall covering system relative to the building as caused by extremes in temperature. This relationship minimizes cracking of the outer exterior cementitious layer because the fibrous insulation can readily separate itself from the hardened base coat without affecting the exterior surface. Furthermore, the fibrous insulation readily compresses should expansion occur between the finish coat and the exterior of the supporting wall.

The fibrous insulation batts or other types of insulating layer provide a temporary surface to which the matting is applied and to which the cementitious base coat is applied. Once the base coat has hardened with the filaments of matting embedded therein, the surface of the insulating layer is no longer required in providing support for the wall cladding exterior relative to the pre-existing building exterior.

Figure 8:
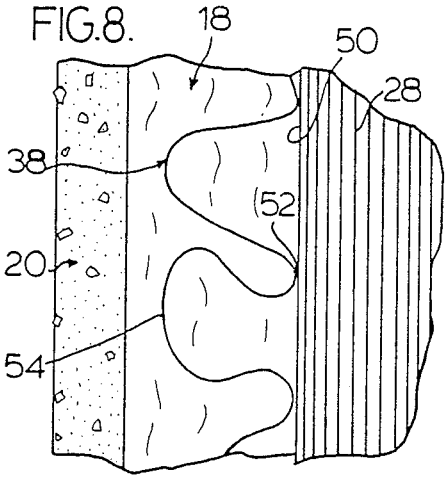
FIGS. 8 and 9 are enlarged sections of the building wall covering system demonstrating the effect of thermal expansion on the matting.
Figure 9:
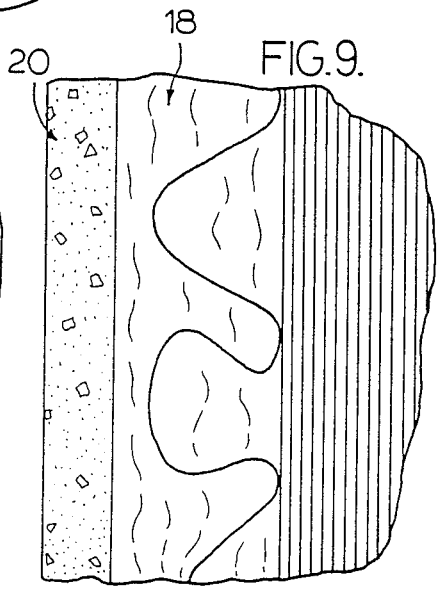

As demonstrated in FIGS. 8 and 9, such thermal expansion of the outer coating layer is shown in more detail. The insulative panel 28 has applied to its exterior control surface 50 the base coat of cementitious material 18. The extremities of the loop define the inner surface 52 of the mat and the outer surface 54 of the mat. The outer finish coat 20 is then applied to the hardened base coat 18. As shown in FIG. 9 in enlarged form, the same layer has expanded due to increase in temperature. The base coat 18 has elongated which is readily compensated for by the matting 38 as the looped portions are distended as demonstrated in FIG. 9. Hence the use of a matting having the interconnected filament structures is not limiting to the expansion and contraction of the wall coating system. This ensures that the wall coating may expand and contract due to thermal gradients without inducing cracking or extreme stresses on the building structure.

It has been found that the use of a matting having a bulky layer of open construction formed by randomly directed, interconnected flexible filaments unexpectedly significantly enhances the impact strength of the outer cementitious layer. The increased impact strength permits either the use of thinner coating of cement layers or with the same thickness of layer as with prior systems, a significantly stronger wall structure is provided. Furthermore, the system is greatly resistant to separation from the building wall by way of its resistance to suction created by high winds. The normal thickness of the base coat is in the range of $\frac{3}{8}''$, whereas the finish coat is approximately 1/16". In using the open construction of matting, it has been found that the base coat combined with the finish coat may be of reduced thickness such as in the range of $\frac{3}{8}''$. This permits the use of less cement material, but still achieves impact strengths of the considerably thicker base materials.

Tests have been conducted on the building wall covering system of this invention employing the construction matting. It has been found in absolute terms that the impact strength of the cementitious base coat has been increased by approximately three times compared to a similar cementitious coating without the matting. A test system was developed by using an acrylic modified, fibre reinforced cementitious base coat of approximately 4 mm in thickness placed over the matting to fill all voids therein. A synthetic texture coat was applied to the base coat. The synthetic texture coat was of approximately 1 mm in thickness. The modulus of rupture (flectural) testing was conducted in accordance with ASTMC-78 and impact resistance testing in accordance with ASTMC-2794 (modified). The results of these test are shown in the following Tables 2 and 3.

TABLE 2

MODULUS OF RUPTURE OF CONSTRUTHERM MARK II

| Specimen # | Modulus of Rupture (psi) |
|---|---|
| 1 | 517 |
| 2 | 495 |
| 3 | 543 |
| Average | 518 |

TABLE 3

IMPACT RESISTANCE OF CONSTRUTHERM MARK II

| Impact Force (in./lb.) | Observations |
|---|---|
| 120 | small indentation 2 mm deep/8 mm dia. |
| 180 | small indentation 3 mm deep/10 mm dia. |
| 205 | small indentation and a hairline crack |
| 240 | structural, open cracking |

From this information, the modulus of rupture was on the average 518 psi which is a significant improvement over prior constructions. The impact resistance of the material was in the range of 240 in./lbs.

A second structure of similar dimensions to that of the wall covering tested above was made up; however, this second structure did not include the matting of open construction. Instead, the layer of cementitious material was applied directly to the insulation material. The impact resistance of this second structure was tested in accordance with the same test procedure as above. It was found to have an impact resistance of approximately 67.5 inch/pounds.

Hence the structure, according to this invention, has an impact resistance at least three times greater than the structure without the matting.

It is appreciated that, due to the enhanced impact resistance and other improvements in the structural strength of the cementitious material having the matting embedded therein, such structure may be used in applications other than wall covering systems. For example, the reinforced cement materials may be used as floor overlays, preformed concrete panels for affixing to building walls and the like, and refurbishing or covering new wall support structures where no insulation is required. For Example, this system may be used in plastering where normally a wire metal lath is used. The matting, according to this invention, may be substituted for the wire metal lath to provide a superior plaster coating.

Although preferred embodiments of the invention have been described herein in detail, it will be understood by those skilled in the art that variations may be made thereto without departing from the spirit of the present invention or the scope of the appended claims.

The embodiments of the invention in which an exclusive property or privilege is claimed are defined as follows:

1. A cementitious building wall covering system comprising a wall support structure, a layer of insulative material and a layer of matting overlying said insulative material, said insulative material and matting being applied to said wall support by spaced apart mechanical fasteners, said matting comprising a bulky layer of open construction formed by randomly directed interconnected flexible filaments randomly looped construction as defined by said interconnected flexible filaments, a continuous layer of hardened cementitious material filling and essentially covering said open construction of said matting, said open construction having approximately 90% or more of its volume normally void and thereby filled with said cementitious material, said matting having a nominal thickness defined by extremities of said loops, said nominal thickness being less than a thickness for said cementitious layer and a hardened finish coat adheres to said layer of cementitious material.

2. A building wall covering of claim 1, wherein said filaments of said matting are monofilaments of Nylon.

3. A building wall covering of claim 1, wherein said layer of insulative material is defined by a plurality of individual panels applied adjacent one another to said supporting wall.

4. A building wall covering of claim 3, wherein said layer of matting is defined by a plurality of individual sections which are positioned adjacent one another in overlying said individual panels of insulation.

5. A building wall covering of claim 4, wherein each of said sections of matting is secured to a corresponding said individual panel of insulation, said section of matting being essentially the same size as said panel of insulation.

6. A building wall covering of claim 5, wherein each said section of matting is offset laterally of said panel of insulation to provide joints for said adjacent said panels of insulation which are offset from joints for adjacent sections of matting.

7. A building wall covering of claim 5, wherein said matting section is secured to said insulation panel by an adhesive or stitching.

8. A building wall covering of claim 1, wherein each of said mechanical fasteners extends through said insulative material and is firmly secured to said wall support structure, each said fasteners having a head portion to which a rigid plate is connected, said rigid plate includes a plurality of apertures extending therethrough, said hardened cementitious layer extending through said apertures in said plate to secure said cementitious layer to said plate, a sufficient number of said fasteners being provided to suspend in a cantilever manner said hardened cementitious layer and matting from said wall support structure essentially independent of said insulative layer to accommodate thereby expansion and contraction movements in said insulation layer without cracking said hardened cementitious layer.

9. A building wall covering of claim 1, wherein said matting of opened construction of flexible filaments accommodates expansion and contraction in said hardened cementitious layer.

10. A building wall covering of claim 1, wherein said hardened cementitious material with said open construction matting embedded therein has an impact resistance in absolute terms approximately three times greater than corresponding impact resistance of said hardened cementitious material without said matting embedded therein.

* * * * *